US005310170A

United States Patent [19]

Yushita et al.

[11] Patent Number: 5,310,170

[45] Date of Patent: May 10, 1994

[54] RECYCLING AUTOMATIC DOCUMENT FEEDER FOR A COPIER

[75] Inventors: Hisahide Yushita; Mitsuhiro Nonaka, both of Yokohama, Japan

[73] Assignee: Ricoh Company, Ltd., Tokyo, Japan

[21] Appl. No.: 114,175

[22] Filed: Sep. 1, 1993

[30] Foreign Application Priority Data

Sep. 2, 1992 [JP] Japan ..... 4-233989

[51] Int. Cl.[5] ..... B65H 3/12

[52] U.S. Cl. ..... 271/3.1; 271/94; 271/98; 271/99; 271/301

[58] Field of Search ..... 271/3.1, 94, 98, 99, 271/35, 301

[56] References Cited

U.S. PATENT DOCUMENTS 5,116,035 5/1992 Russel ..... 271/3.1

5,152,515 10/1992 Acquaviva ..... 271/3.1

*Primary Examiner*—Richard A. Schacher

*Attorney, Agent, or Firm*—Oblon, Spivak, McClelland, Maier & Neustadt

[57] ABSTRACT

A recycling automatic document feeder (RADF) for a copier or similar image forming apparatus and capable of preventing curled or otherwise deformed documents from being damaged when such documents are recirculated. The RADF includes a parting plate for separating part of a stack of documents not undergone illumination from the other part undergone illumination and returned to the stack. When the parting plate is raised to a level above a predetermined height, the RADF is inhibited from returning the illuminated documents to the stack.

2 Claims, 7 Drawing Sheets

RECYCLING AUTOMATIC DOCUMENT FEEDER FOR A COPIER

BACKGROUND OF THE INVENTION

The present invention relates to a recycling automatic document feeder (RADF) for a copier or similar image forming apparatus and, more particularly, to an RADF capable of preventing curled or otherwise deformed documents from being damaged when they are recirculated.

An RADF is generally constructed to transport the lowermost one of documents stacked on a document table to a predetermined document set position on a copier and, after the document has been illuminated by the copier, returns it to the table. To separate the lowermost sheet from the other sheets, air under pressure may be blown against one edge of the stack of documents, as disclosed in Japanese Utility Model Laid-Open Publication No. 127681/1990 by way of example. Specifically, in this type of RADF, a nozzle blows compressed air against the edge of a document stack set on a document table face down. At the same time, a suction tank sucks the lowermost document to retain it on a feed belt, while separating it from the other documents. The RADF has an opening for receiving the documents sequentially returned after illumination. A parting plate is disposed in this opening and presses the documents having not illuminated, thereby separating such documents from the documents returned after illumination.

However, the conventional RADF described above has some problems left unsolved, as follows. Assume that the documents stacked on the document table are noticeably curled. Then, when documents undergone illumination are sequentially returned to the table, the parting plate raised by the underlying curled documents obstructs and damages the returned documents. Moreover, when the parting plate is raised by the underlying curled stack to an excessive level, it loses the expected function and allows the returned documents to run onto the stack. This prevents the returned documents from being distinguished from the non-illuminated documents, i.e., prevents the last document of the non-illuminated stack from being identified. As a result, the RADF fails to transport the documents with accuracy.

SUMMARY OF THE INVENTION

It is, therefore, an object of the present invention to provide a highly reliable RADF capable of protecting documents from damage despite the recirculation thereof.

An RADF of the present invention comprises a document table, a nozzle for blowing air against the edge of a stack of documents set on the document table, a suction tank for sucking the lowermost document of the stack, a feeding device for feeding the lowermost document being sucked by the suction tank, a transporting device for transporting the document fed by the feeding device to a predetermined document set position and then returning the document to the document table, a parting plate resting on part of the documents stacked on the document table and having not fed by the feeding device, thereby separating that part of the documents from the other part having been returned by the transporting device, a sensor for sensing the height of a portion of the stack which adjoins the parting plate, and a controller for inhibiting, when the sensor determines that the portion of the stack adjoining the parting plate is higher than a predetermined height, the feeding device and transporting device at least from returning the documents to the document table.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 9:
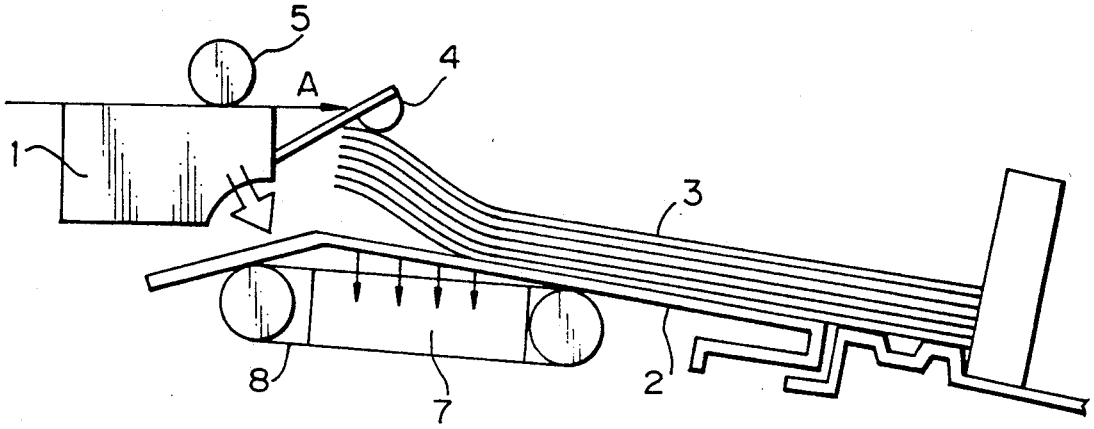
Fig. 9 PRIOR ART
FIGS. 9 and 10 are views indicative of a problem particular to a conventional RADF.
Figure 10:
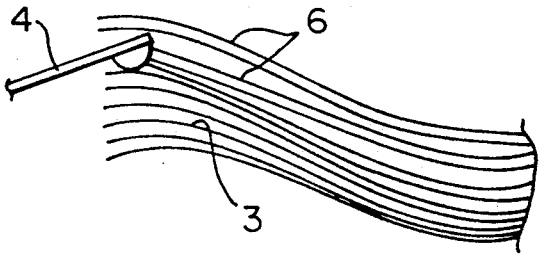
Fig. 10 PRIOR ART

To better understand the present invention, a brief reference will be made to a conventional RADF, shown in FIGS. 9 and 10. The conventional RADF is of the air separation type taught in previously stated Japanese Utility Model Laid-Open Publication No. 127681/1990. The figures show part of such an RADF to which documents undergone illumination are sequentially returned. As shown, the RADF has a nozzle 1, a document table 2, a stack of curled documents 3, a parting plate 4, a return roller 5, documents 6 undergone illumination and returned, a suction tank 7, and a feed belt 8. This type of RADF has the following problems. Assume that the documents 3 stacked on the table 2 are noticeably curled, as illustrated. Then, when documents 6 undergone illumination are sequentially returned by the return roller 5 in a direction indicated by an arrow A in FIG. 9, the parting plate 4 raised by the curled stack 3 obstructs and damages the documents 6. Moreover, when the parting plate 4 is raised by the curled stack 3 to an excessive level, it loses the expected function and allows the returned documents 6 to run onto the stack 3, as shown in FIG. 10. This prevents the returned documents 6 from being distinguished from the non-illuminated documents 3, i.e., prevents the last document of the non-copied stack 3 from being identified. As a result, the RADF fails to transport the documents with accuracy.

Figure 1:
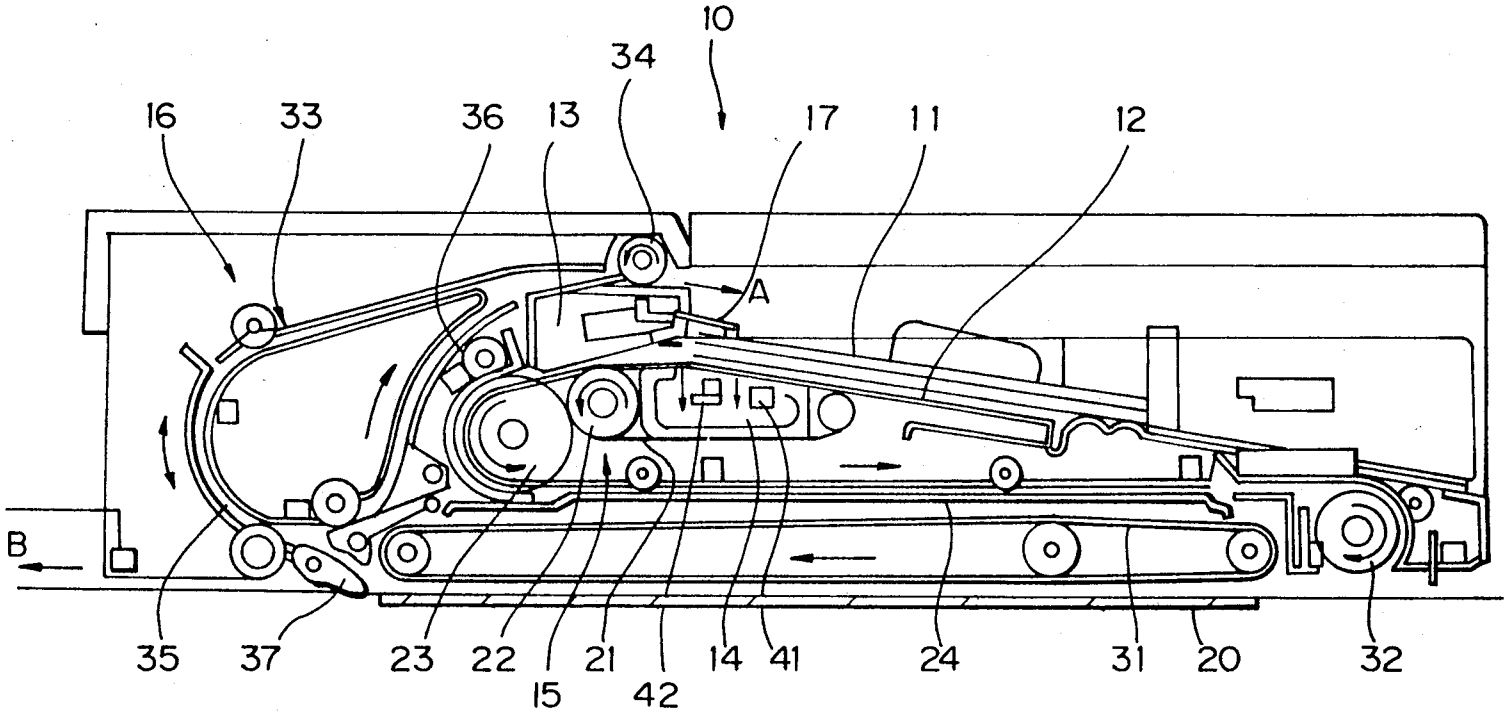
FIG. 1 is a sectional front view showing an RADF embodying the present invention.

Referring to FIG. 1, an RADF embodying the present invention is shown and generally designated by the reference numerals 10. The RADF 10 is mounted on the top of a conventional copier. As shown, documents 11 are stacked on a document table 12 face down. A nozzle 13 blows air under pressure against the edge of the stack 11. A suction tank 14 sucks the lowermost document of the stack 11. A feeding device 15 separates and feeds the lowermost sheet being sucked by the suction tank 14 from the stack 11. A transporting device 16 transports the document fed by the feeding device 15 to a predetermined position, e.g., a position defined on a glass platen 20 and where a scanning device, included in the copier body although not shown, illuminates the document. This position will be referred to as an exposure position hereinafter. Further, the transporting device 16 returns the document undergone illumination to the table 12 or drives it out to a tray located at the left-hand side of the RADF, although not shown in the figure. A parting plate 17 separates the documents 11 not undergone illumination and documents 17 undergone illumination and returned to the table 12. The RADF 10 is constructed to repetitively return the documents copied once to the table 12 a number of times corresponding to the desired number of sets of copies. A finisher, not shown, is connected to the copier for binding a single set of copies every time the RADF 10 completes a recirculation.

The nozzle 13 and suction tank 14 are each constructed and operated in the conventional manner. Specifically, while the nozzle 13 blows air against the edge of the document stack 11 to break it up, the suction tank 14 sucks the lowermost one of the documents 11. The feeding device 15 is made up of a feed belt 21, a pick-up roller 22, and a feed roller 23. The lowermost document 11 is retained by the belt 21 due to the suction effected by the suction tank 14. The pick-up roller 22 is rotated to rotate the belt 21 in a direction indicated by an arrow in the figure. As a result, the feed belt 21 separates the document 11 retained thereon from the other documents 11 and conveys it to the feed roller 23. The feed roller 23 drives the document into an intermediate transport path 24 having a plurality of rollers and terminating at the transporting device 16.

The transporting device 16 has a transport belt 31, a transport roller 32, a return section 33, and a return/discharge path selector 37. The document coming out of the intermediate path 24 is handed over to the belt 31 by the roller 32. Then, the belt 31 conveys the document to the previously mentioned exposure position and stops it there. After the document has been illuminated by the exposing device, the belt 31 transports the document to the return section 33. In a one-sided copy mode, the document is driven into a turn-over path 35 until a sensor, not shown, senses the trailing edge of the document. As soon as the sensor senses the trailing edge of the document, rollers arranged on the turn-over path 35 are reversed to convey the document to a return roller 34 while maintaining it face down. On the other hand, in a two-sided copy mode, the document undergone illumination is driven to the return roller 34 face up via the turn-over path 35. The return roller 34 drives the document coming out of the return path 35 or a return path 36 to the table 12, as indicated by an arrow A in the figure.

When a control system, which will be described later, generates a discharge signal, the transporting device 16 rotates the path selector 37 upward as viewed in FIG. 1, thereby blocking the path to the return section 33. As a result, the document conveyed by the belt 31 is driven out of the RADF 10 to the previously mentioned tray in a direction indicated by an arrow B in the figure.

Also shown in FIG. 1 are a document set sensor 41 responsive to the documents 11 stacked on the table 12, and a document end sensor 42. When all the documents 11 stacked on the table 12 are fed out for illumination by the feeding device 15, the parting plate 17 falls and is sensed by the document end sensor 42.

The parting plate 17 rests on the uppermost one of the documents 11 having not fed from the table 12 so as to separate them from the documents 11 returned after illumination.

Figure 2:
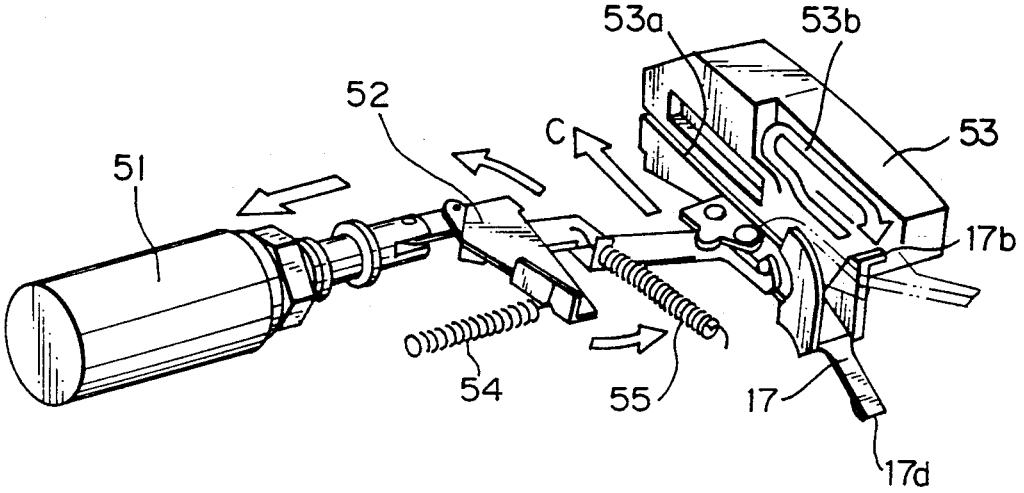
FIG. 2 is a perspective view of a mechanism for operating a parting plate included in the embodiment.
Figure 3:
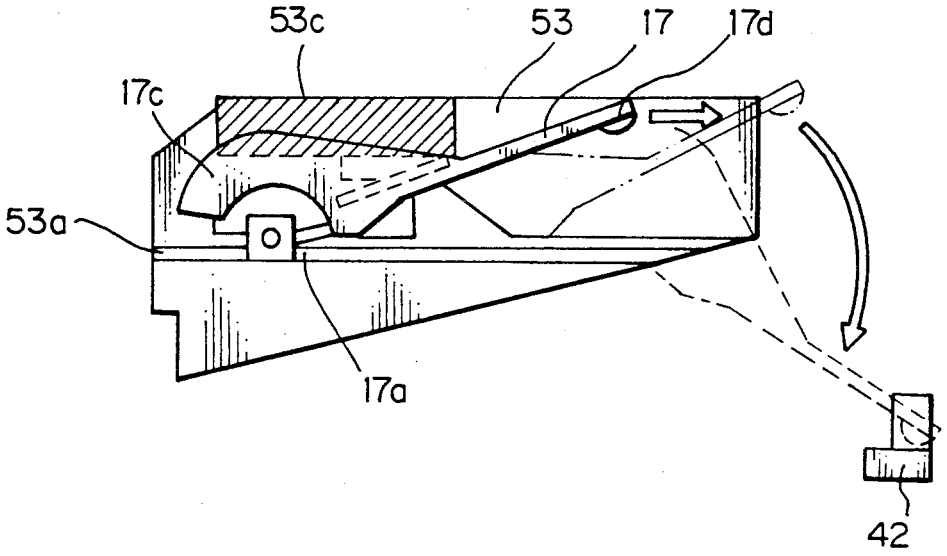
FIG. 3 shows how the parting plate is rotable.

FIGS. 2 and 3 show a mechanism for operating the parting plate 17. As shown, the parting plate 17 includes a flat portion **17*a* and a pin 17*b*. When a solenoid 51 is energized, it rotates an arm 52 counterclockwise, as viewed in FIG. 2. Then, the parting plate 17 is moved in a direction indicated by an arrow C in FIG. 2. At this instant, the flat portion 17*a* and pin 17*b* of the plate 17 respectively move along rails 53*a* and 53*b* provided on a guide 53. Another flat portion 17*c* included in the plate 17 is attracted by a magnet 53*c* also provided on the guide 53. Consequently, the plate 17 has the free end 17*d* thereof lifted, as indicated by a solid line in FIG. 3. When the solenoid 51 is deenergized, the arm 52 is rotated clockwise by a spring 54 with the result that the parting plate 17 is moved to a phantom line position of FIG. 3 by a spring 55. At this position, the free end 17*d* of the parting plate 17 abuts against the top of the stack 11 on the table 12. When all the documents are fed out form the table 12 by the feeding device 15, the free end 17*d* of the parting plate 17 falls to the phantom line position of FIG. 3 and is sensed by the document end sensor 42**.

Figure 4:
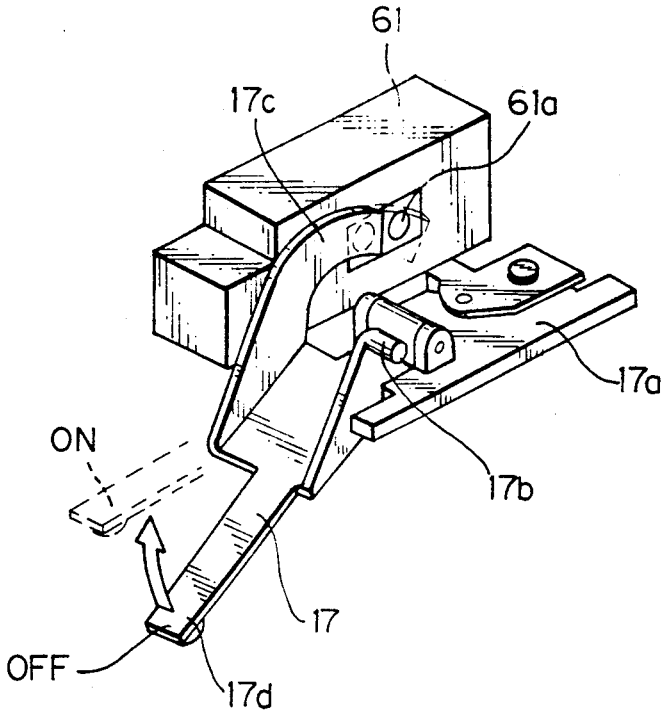
FIG. 4 is a perspective view showing the arrangement of a document height sensor also included in the embodiment.
Figure 5:
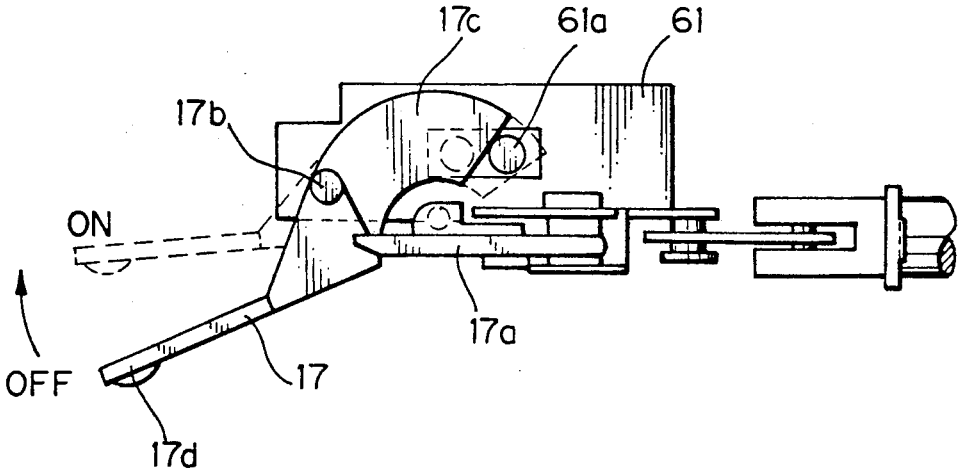
FIG. 5 demonstrates how the document height sensor turns on and turns off.

FIGS. 4 and 5 show a document height sensor 61 located in the vicinity of the parting plate 17. As shown, the sensor 61 has a sensing portion **61*a* for sensing the flat portion 17*c* of the parting plate 17 when the plate 17 is raised to a predetermined height. Therefore, whether the sensor 61 is ON or OFF indicates whether or not part of the document stack 17 adjoining the parting plate 17 has exceeded a predetermined height. For example, the parting plate 17 is determined to lie in a normal range so long as it is positioned below a phantom line position shown in FIG. 5. In this condition, the sensor 61 remains in an OFF state. However, when the parting plate 17 rises above the phantom line position, the sensor 61 turns on since the plate 17 would otherwise obstruct and damage documents being returned. In this manner, the sensor 61 plays the role of document height sensing means responsive to the height of part of the document stack 11 which adjoins the parting plate 17. The output of the sensor 61 is sent to an RADF control board which will be described with reference to FIG. 6**.

Figure 6:
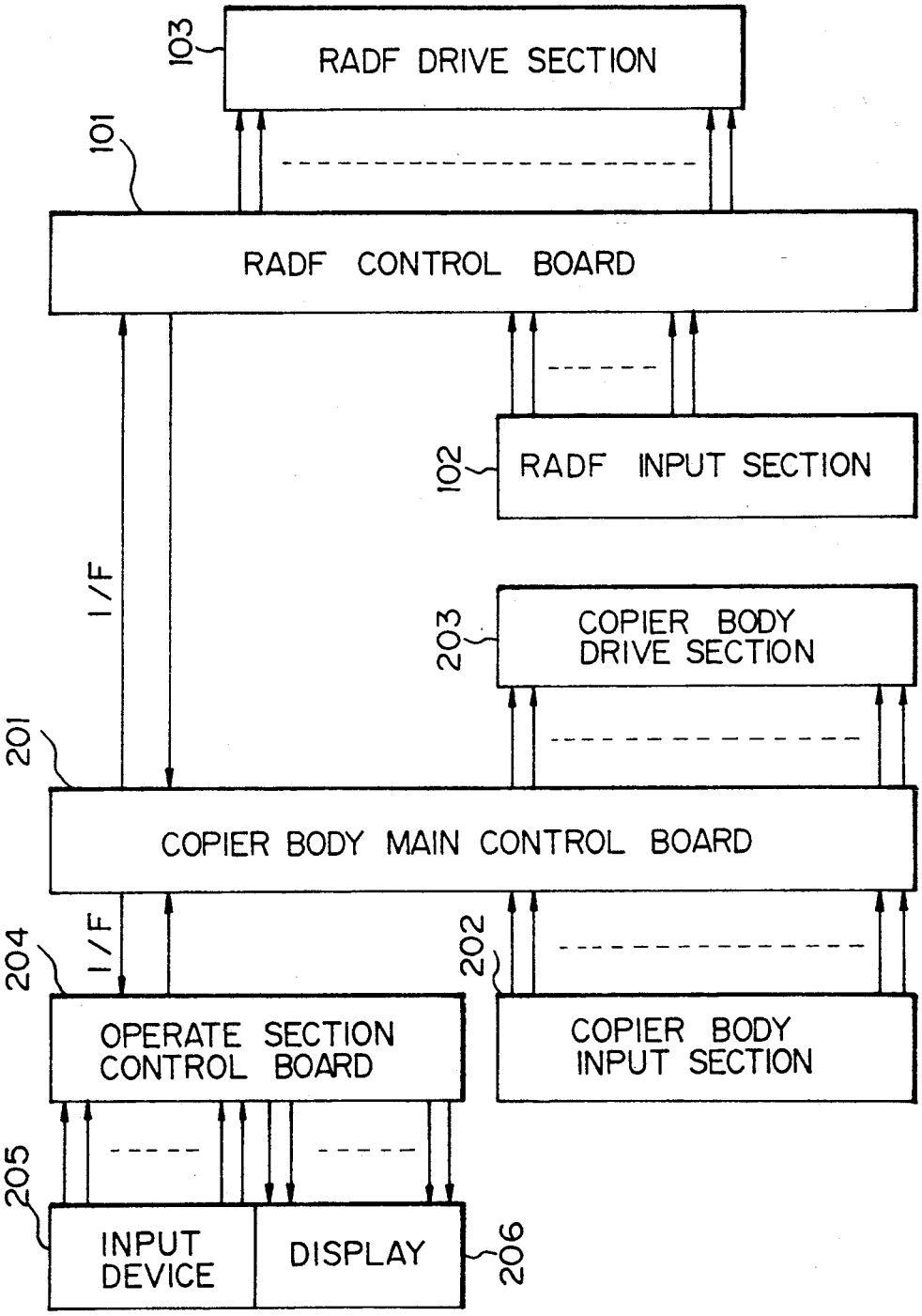
FIG. 6 is a block diagram schematically showing a control system, inclusive of a copier, particular to the embodiment.

Referring to FIG. 6, a control system included in the embodiment is shown. As shown, the control system has an RADF control board 101, an RADF input section 102, and an RADF drive section 103. The RADF control board 101 is provided with a CPU (Central Processing Unit), a memory, and an input/output circuit and connected to the input section 102 and drive section 103 by cables to interchange signals therewith. The input section 102 includes the document set sensor 41, document end sensor 42 and document height sensor 61 arranged in the RADF 10. The outputs of these sensors are sent to the control board 101. The drive section 103 includes drivers for driving a device for supplying air under pressure to the nozzle 13 and a device for causing the suction tank 14 to suck air, as well as drivers for driving the feeding device 15 and transporting device 16. This section 103 drives such drivers in response to control signals fed from the control board 101. In this sense, the control board 101 serves as a controller for controlling the feeding device 15 and transporting device 16. Specifically, when the flat portion 17*c* of the parting plate 17 resting on the document stack 11 turns on the document height sensor 61, the control board 101 inhibits the devices 15 and 16 at least from returning the illuminated document to the table 12. For example, the control board 101 fully stops the operations of the devices 15 and 16 and, at the same time, displays the defective set condition of the document stack 11 on a display 206. In the illustrative embodiment, even when the sensor 61 is turned on, the control board 101 allows the devices 15 and 16 to operate if the number of times of recirculation entered on an inputting device 205 is only once. At the same time, the control board 101 raises the path selector 37 to discharge the illuminated documents to the tray, instead of returning them to the table 12. However, when the number of times of recirculation is twice or more, the control board 101 stops the operations of the devices 15 and 16.

The copier body includes a copier main control board 201, a copier input section 202, a copier drive section 203, and an operating section control board 204. The main control board 201 includes a CPU, a memory, and an input/output circuit and interchanges signals with the RADF control board 101, copier input section 202, copier drive section 203, and copier control board 204 over predetermined cables. The operating section control board 204 is connected to the inputting device 205 and display 206. The inputting device 205 is operated to input the number of times of recirculation and other information to be set. The display 206 informs the operator of the end of processing, errors, and so forth. The input section 202 is constituted by sensors arranged in the copier body, although not shown in the figure. The outputs of these sensors are sent to the main control board 201 via the input section 202. The drive section 203 includes drivers for driving the copier body in response to control signals from the main control board 201. On receiving the information entered on the inputting device 205, the operating section control board 204 transfers them to the main control board 201, while transferring information from the main control board 201 to the display 206.

Figure 7:
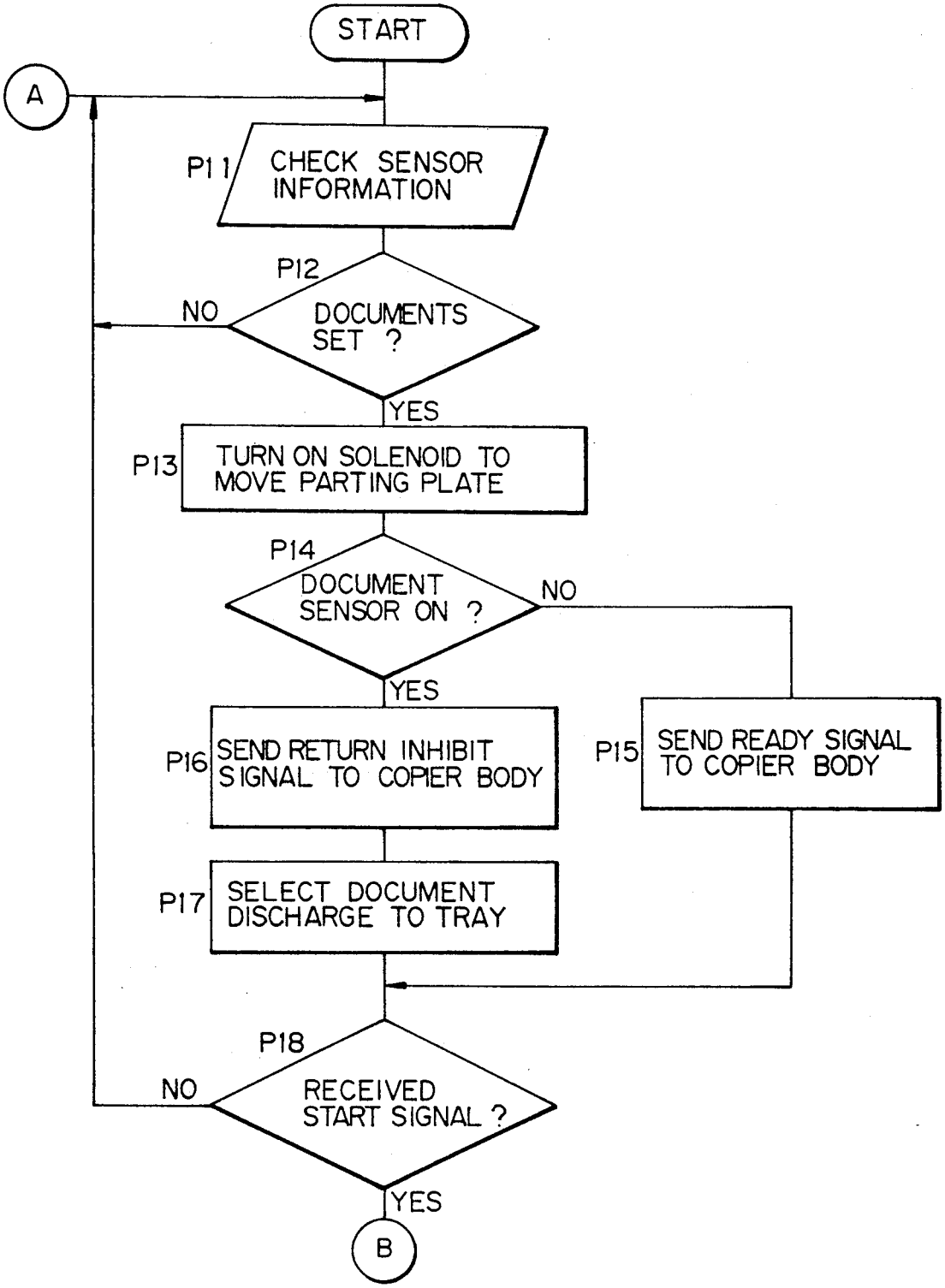
FIGS. 7 and 8 are flowcharts demonstrating, in combination, a specific operation of an RADF control board included in the control system of FIG. 6.
Figure 8:
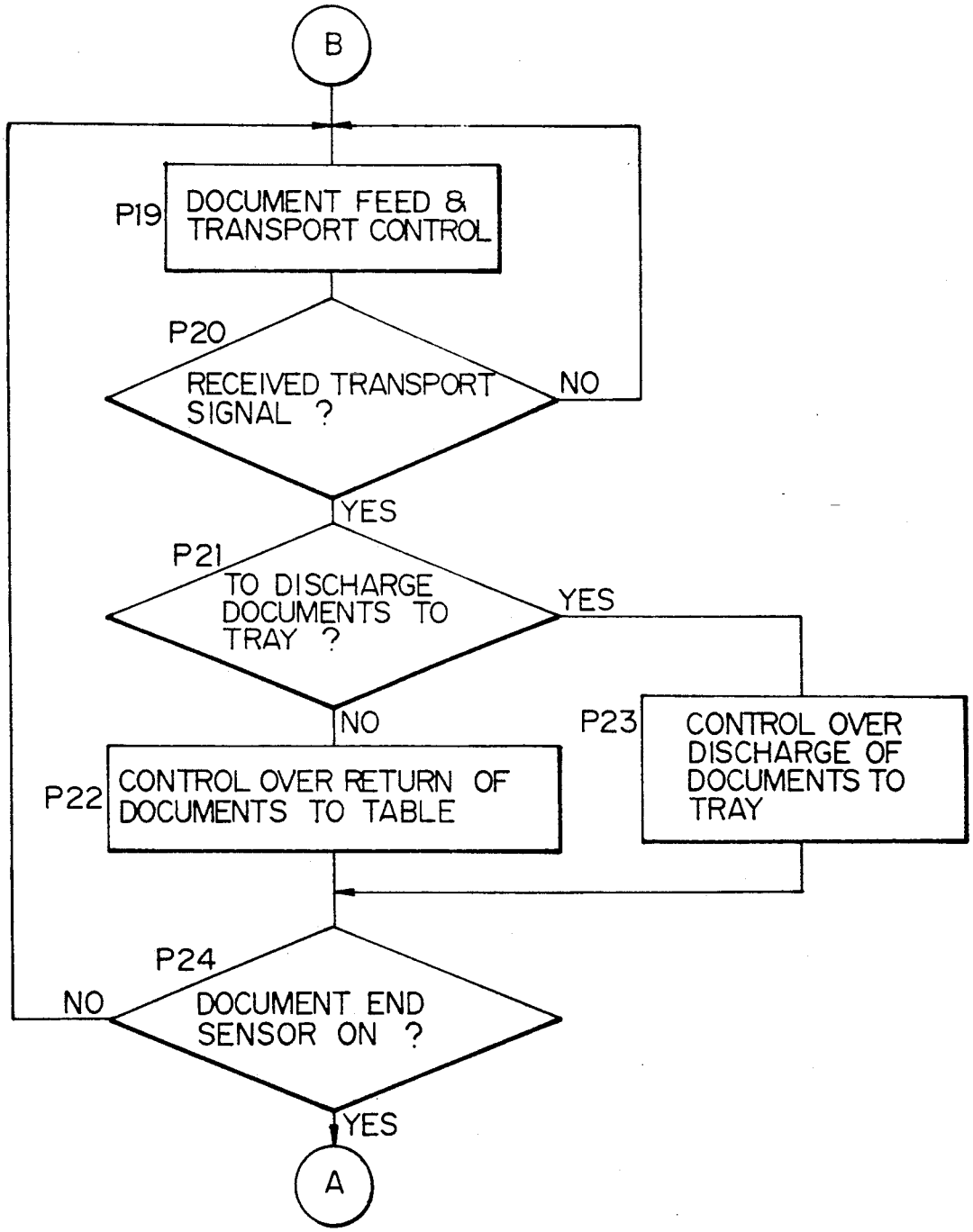

A reference will be made to FIGS. 7 and 8 for describing a specific operation of the RADF control board 101. As shown, when a power source is turned on, the control board 101 checks error information and other information associated with the sensors of the RADF input section 102 (step P11). Then, the control board 101 determines whether or not documents are set on the table 12 by referencing the output of the document set sensor 41 (step P12). If the answer of the step P12 is negative, NO, the program returns to the step P11. If it is positive, YES, the control board 101 sends a signal to the RADF drive section 103 to energize the solenoid 51 (step P13). As a result, the free end 17*d* of the parting plate 17 is caused to abut against the document stack 11. Subsequently, the control board 101 determines whether or not the document height sensor 61 is in an ON state (step P14). If the sensor 61 is not in an ON state, NO, the control board 101 sends a ready signal to the main control board 201. On receiving the ready signal, the main control board 201 sends a start signal accept signal to the control board 101. The reception of the start signal accept signal is determined in a step P18. If the document height sensor 61 is in an ON state (YES, step S14), the control board 101 sends a return inhibit signal to the main control board 201 to inhibit the illuminated documents from being returned to the table 12 (step P16). On receiving the return inhibit signal, the main control board 201 sends a start signal accept signal to the RADF control board 101 if the set number of recirculation is once or sends a start signal reject signal to the RADF control board 101 and displays the inhibited condition on the display 206. In a step P17, the control board 101 delivers a control signal to the RADF drive section 103 for causing it to discharge the illuminated documents to the tray. In the step P18, the control board 101 determines whether or not it has received a start signal from the main control board 201. If the answer of the step P18 is negative, NO, the program returns to the step P11. If it is positive, YES, the control board 101 sends a control signal to the RADF drive section 103 to transport the lowermost document of the stack 11 to the exposure position of the copier body and stop it there (step P19). In this condition, the copier body copies the document and then sends a transport signal to the RADF control board 101 for causing it to transport the illuminated document from the exposure position. The control board 101 determines whether or not it has received the transport signal (step P20) and, if the answer is negative, returns to the step P19. If the control board 101 has received the transport signal, the control board 101 determines whether or not it has received a discharge signal for discharging the illuminated documents to the tray (step P21). If the answer of the step P21 is positive, YES, the control board 101 sends a control signal to the RADF drive section 103 to drive the illuminated documents to the tray (step P23). If the answer of the step P21 is negative, NO, the control board 101 sends a control signal to the RADF driver 103 to return the illuminated documents to the table 12 (step P22). Subsequently, the control board 101 determines whether or not the document end sensor 42 has sensed the free end 17*b* of the parting plate 17, i.e., whether or not the sensor 42 has turned on (step P24). If the answer of the step P24 is negative, NO, the program returns to the step P19; if otherwise, the program returns to the step P11, FIG. 7.

As stated above, when the sensing portion 61*a* of the document height sensor 61 is turned on by the parting plate 17, the RADF control board 101 generates a return inhibit signal for preventing the illuminated documents from being returned to the table 12. If the number of times of recirculation is once, the copying operation is executed in which the illuminated documents are driven out to the tray. However, if it is twice or more, the copying operation is inhibited. As a result, even when the parting plate 17 is raised above the predetermined height by, e.g., curled documents stacked on the table 12, the documents are prevented from being returned to the table 12 after illumination and, therefore, protected from damage. In addition, since the documents undergone illumination are not returned to the table 12, the occurrence that the documents not undergone illumination and the documents undergone illumination cannot be distinguished is eliminated. If the number of times of recirculation is once, the documents can be copied at high speed.

In the illustrative embodiment, the documents are fed and transported only when the document height sensor 61 is in an ON state and the number of times of recirculation is once. Alternatively, when the number of times of recirculation is twice or more, the recirculation may be effected only once to drive the documents out of the copier to the tray.

In summary, it will be seen that the present invention provides an RADF for a copier which inhibits, among the operations of a feeding device and a transporting device, a returning operation on determining that the height of a document stack, as measured in the vicinity of a parting plate, is higher than a predetermined height. This prevents curled documents from being returned and damaged and provides the RADF with unprecedented reliability.

Moreover, when the above-mentioned height of the stack is higher than the predetermined one, the RADF discharges the document to a tray if the desired number of times of recirculation is once. Hence, the RADF completes a single recirculation rapidly despite such a position of the stack.

Various modifications will become possible for those skilled in the art after receiving the teachings of the present disclosure without departing from the scope thereof.

What is claimed is:

1. A recirculating automatic document feeder (RADF) comprising:

a document table;

a nozzle for blowing air against an edge of a stack of documents set on said document table;

a suction tank for sucking a lowermost document of said stack;

feeding means for feeding said lowermost document being sucked by said suction tank;

transporting means for transporting the document fed by said feeding means to a predetermined document set position and then returning said document to said document table;

a parting plate resting on part of the documents stacked on said document table and having not fed by said feeding means, thereby separating said part of said documents from the other part of said documents having been returned by said transporting means;

sensing means for sensing a height of a portion of said stack which adjoins said parting plate; and control means for inhibiting, when said sensing means determines that said portion of said stack adjoining said parting plate is higher than a predetermined height, said feeding device and said transporting device at least from returning said documents to said document table.

2. An RADF as claimed in claim 1, further comprising a tray for receiving said documents fed from said document table, but not to be recirculated;

said controlling means causing, when said sensing means determines that said portion of said stack is higher than said predetermined height and the number of times that said documents should be transported to said document set position is only once, said feeding means and said transporting means to discharge said documents fed from said document table to said tray.

* * * * *